US007258198B2

(12) United States Patent
Rexroad

(10) Patent No.: US 7,258,198 B2
(45) Date of Patent: Aug. 21, 2007

(54) PERIMETER NET SYSTEM WITH SUPPORT ARM LOCK

(76) Inventor: John Rexroad, 500 Main St., P.O. Box 1019, Deep River, CT (US) 06417

( * ) Notice: Subject to any disclaimer, the term of this patent is extended or adjusted under 35 U.S.C. 154(b) by 284 days.

(21) Appl. No.: 11/089,620

(22) Filed: Mar. 24, 2005

(65) Prior Publication Data

US 2006/0213723 A1 Sep. 28, 2006

(51) Int. Cl.
*E04G 21/00* (2006.01)

(52) U.S. Cl. ..... 182/138; 182/82

(58) Field of Classification Search ..... 182/138, 182/82, 113
See application file for complete search history.

(56) References Cited

U.S. PATENT DOCUMENTS 3,949,834 A * 4/1976 Nusbaum ..... 182/138
4,074,791 A * 2/1978 Inman ..... 182/138
4,119,176 A * 10/1978 Verdu ..... 182/138
4,732,234 A * 3/1988 Brickman ..... 182/138
4,856,615 A * 8/1989 Nusbaum ..... 182/82
5,749,438 A * 5/1998 Rothkirch ..... 182/138

* cited by examiner

*Primary Examiner*—Alvin Chin-Shue
(74) *Attorney, Agent, or Firm*—Venable, Campillo, Logan & Meaney

(57) ABSTRACT

A perimeter net system with the capability of rotating between an open and a close position is described. The perimeter net system includes a support arm, a lock arm, a support arm storage lock, a support cable, a pivot bracket, and a net. These components work together to allow a safety net system to easily be folded against a building for repairs or in inclement weather conditions. The support arm rotates to a closed position on the pivot bracket, and the lock arm adjusts with the support arm. Once in the closed position, the support arm storage lock secures the support arm and the lock arm in place.

20 Claims, 3 Drawing Sheets

PERIMETER NET SYSTEM WITH SUPPORT ARM LOCK

BACKGROUND

The present invention relates generally to an apparatus used for restraining falling objects, more particularly, to an apparatus that comprises a net system that maintains a safe area for the public, crews, and surrounding property where there is a potential for falling objects, and in particular, construction workers on or around a high rise building. Specifically, the present invention is a safety net system with an adjustable support arm that rotates between an open and closed position. The adjustable support arm allows for easy maintenance on the net, superior protection of the net system in inclement weather, and necessary protection of the public, a construction crews, and property.

A construction crew maintaining a building or structure must deal with many hazards in the work environment. Members of the crew on the ground and in the air must be constantly aware of their surroundings to prevent injuries from falls or falling objects. Additionally, the public on the ground must watch for dropped objects falling from above that could cause bodily injury or property damage.

One way to ensure protection of the crew, the public, and property is to install a net system that surrounds the perimeter of the building or structure near the area where objects may fall. However, once the net system is installed it can be difficult to make repairs to the net system, adjust the angle of the net, or protect the net system during inclement weather conditions. The difficulty in repairing and protecting the net system can result in a hazardous condition for crew members, the public, and property. Because the maintenance and protection of the net system once it is installed is so difficult, crew members may avoid making the proper repairs and taking the proper steps to protect the net system, ultimately causing accidents.

The present invention provides an easy and secure way to repair and protect an installed net system. The present invention is a perimeter net system with an adjustable support arm. The adjustable support arm allows crews to pull the net system in toward the structure for repairs or protection from inclement weather conditions such as high winds. Additionally, the various configurations of the net system between the open and closed positions provide improved protection to people and property below the structure from falling objects. Specifically, the net system can be angled in a position that directs falling objects toward the structure rather than straight toward the ground.

Moreover, the support arm is secured with a support arm lock when the net system is in position for repairs or protection from inclement weather conditions. When the net system is in an open position and the safety net is being used to protect construction workers, the public, and surrounding property from falling objects, it is rigidly secured with a lock arm. The adjustability and securing mechanism of the support arm is critical because the crews must be able to properly deploy and maintain the net system.

Currently, there are devices that use nets attached to buildings to protect people working on maintenance crews, members of the public accessing areas below the building or structure, and property on the ground that could be damaged by falling objects. However, each of these devices suffers from several disadvantages. First, the devices are difficult to maintain and protect against inclement weather conditions and in particular, high winds. The net systems are large protrusions and can be damaged while in the environment.

Second, because the net systems are non-adjustable, they must be completely taken off the building to make repairs and protect them from the weather. Once the repairs are made or the weather conditions become more favorable, the net systems must all be reinstalled.

Presently, there is no net system that is easy to maintain and protect from inclement weather conditions and is capable of adjusting and storing in a safe manner. For the foregoing reasons, there is a need for a device that allows crews to easily maintain and protect a net system around a building or structure.

SUMMARY

The present invention is directed to a device that satisfies the needs of being simple to repair and deploy once installed, of not being affected by the wind when deployed, being protected from inclement weather conditions, providing an adjustable support arm, and being quickly and easily positioned to protect people from falling objects.

A perimeter net system having features of the present invention comprises a support arm, a pivot bracket, a lock arm, a support arm storage lock a support cable, and a net. The first and second ends of the support arm are coupled to the pivot bracket and the bottom of the support cable, respectively. In this configuration, the support arm is able to rotate around the axis of the pivot bracket so the net that attaches to the support arm at two points with net cables can be moved toward the building for repairs and protection. The top of the support cable is attached to the storage arm lock and provides added strength to the support arm. The lock arm provides the perimeter net system with rigidity when the support arm is deployed at any angle between the open and closed positions. The upper end of the lock arm is detachably coupled to the support arm storage lock, and the lower end of the lock arm is coupled along the length of the support arm. As the support arm rotates between the open and closed positions, the lower end of the lock arm telescopes into the upper member of the lock arm and is secured when the support arm reaches the desired angle.

The novel features that are considered characteristic of the invention are set forth with particularity in the appended claims. The invention itself, however, both as to its structure and its operation together with the additional object and advantages thereof will best be understood from the following description of the preferred embodiment of the present invention when read in conjunction with the accompanying drawings. Unless specifically noted, it is intended that the words and phrases in the specification and claims be given the ordinary and accustomed meaning to those of ordinary skill in the applicable art or arts. If any other meaning is intended, the specification will specifically state that a special meaning is being applied to a word or phrase. Likewise, the use of the words "function" or "means" in the Description of Preferred Embodiments is not intended to indicate a desire to invoke the special provision of 35 U.S.C. §112, paragraph 6 to define the invention. To the contrary, if the provisions of 35 U.S.C. §112, paragraph 6 are sought to be invoked to define the invention(s), the claims will specifically state the phrases "means for" or "step for" and a function, without also reciting in such phrases any structure, material, or act in support of the function.

Moreover, even if the provisions of 35 U.S.C. §112, paragraph 6 are invoked to define the inventions, it is intended that the inventions not be limited only to the specific structure, material or acts that are described in the preferred embodiments, but in addition, include any and all structures, materials or acts that perform the claimed function, along with any and all known or later developed equivalent structures, materials, or acts for performing the claimed function.

DESCRIPTION OF PREFERRED EMBODIMENTS

Figure 1:
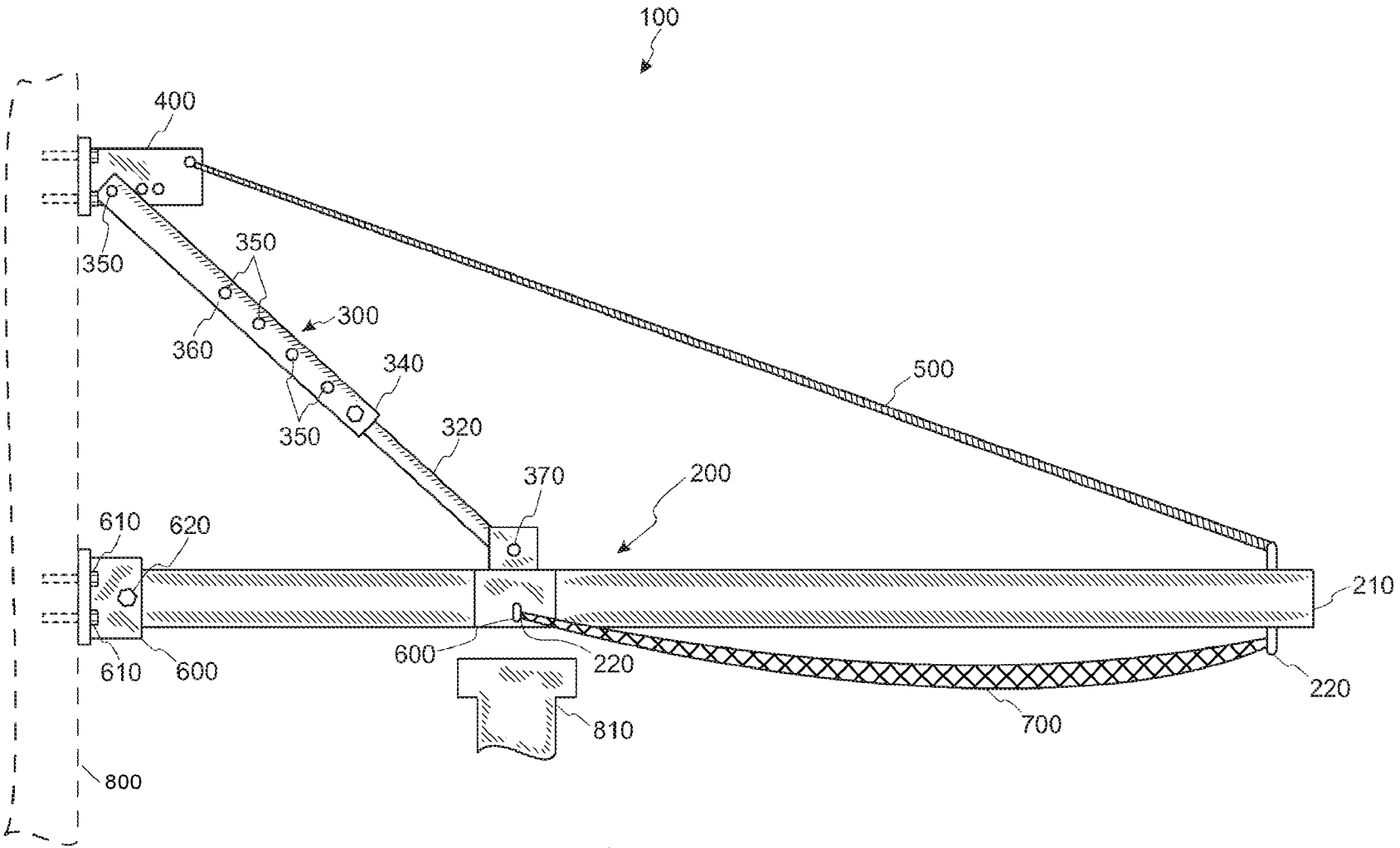
FIG. 1 shows a side view of the perimeter net system in the open position with the net coupled to the support arm some distance from the mounting bracket.

As shown in FIG. 1, the preferred embodiment of the perimeter net system 100 generally includes a support arm 200, a lock arm 300, a support arm storage lock 400, a support cable 500, a pivot bracket 600, and a net 700. These components work together to create a perimeter net system 100 that rotates and can be secured at various angles to protect people and property from falling objects. As the angle of the support arm 200 adjusts, the lock arm 300 rigidly secures the support arm 200 in place so that the attached net 700 is in position to protect people and property from falling objects.

Figure 2:
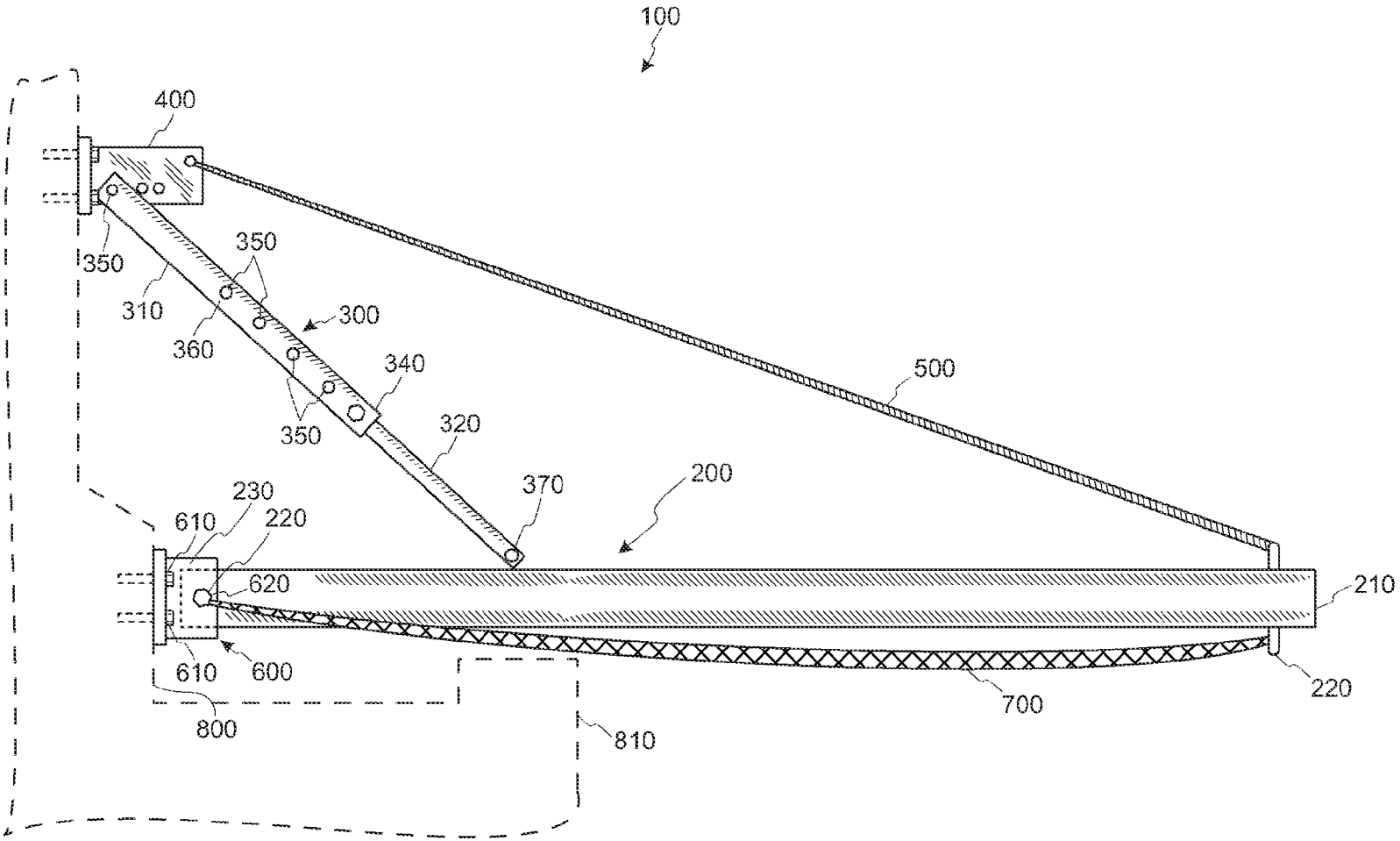
FIG. 2 shows a side view of another embodiment of the perimeter net system in the open position with the net coupled to the end of the support arm.

It is preferred that the pivot bracket 600 is attached to a building support structure 800, such as a wall, a beam, a window, ledge, or a roof, with bolts 610. The inside end 230 of the support arm 200 is attached to the pivot bracket 600 with a pivot pin 620 that allows the support arm 200 to rotate between an open position, as in FIGS. 1 and 2, and a closed position, as in FIG. 3. When the perimeter net system 100 is in the open position, the support arm 200 is substantially horizontal with the ground, and the net 700 is in position to catch falling objects. When in the closed position, support arm 200 is substantially perpendicular to the ground, and the net 700 can be removed from the support arm 200 for repairs or protection from the weather. In addition to the open and closed positions, the support arm 200 can be adjusted to any angle in between. When the support arm 200 forms an acute angle with the building or structure, the falling objects are directed toward the structure.

The net 700 is attached to the support arm 200 with net cables 220. In the preferred embodiment, as shown in FIG. 1, the net cables 220 are attached to the outside end 210 of the support arm 200 and at the point along the length of the support arm 200 above where the building 810 ends. This configuration allows the net 700 to protect all falling objects from going over the edge of the building 810 while at the same time keeping the area between the edge of the building 810 and the building support structure 800 clear for the crew to perform their necessary duties. In an alternate embodiment, shown in FIG. 2, the net cables 220 are attached to the outside end 210 of the support arm 200 and the inside end 230 of the support arm 200. This configuration of the net 700 provides protection from falling objects from the outside end 210 of the support arm 200 to the building support structure 800.

The support arm 200 is secured with a lock arm 300 and a support cable 500 when the support arm 200 is in the open position or any position between the open and closed positions. In the preferred embodiment, the lock arm 300 consists of an upper member 310 and a lower member 320. The upper member 310 detachably connects to the support arm storage lock 400 and the lower member 320. The lower member 320 of the lock arm 300 connects to the support arm 200 with a pivot pin 370 such that the lock arm 300 rotates around the axis of the pivot pin 370 as the support arm 200 adjusts to the closed position.

In the preferred embodiment, the upper member 310 of the lock arm 300 has notches 350 that are spaced along the length of the upper member 310. The notches 350 allow the lock arm 300 to be adjustable while still acting as a means for securing the support arm 200. A removable securing device 360, such as a bolt or pin, is inserted into one of the notches 350 to secure the upper member 310 to the support lock arm 400; and another removable securing device 360 is inserted into a notch 350 at a lower position on the upper member 310 to secure the lower member 320 to the upper member 310. As the support arm 200 adjusts to the closed position, the removable securing devices 360 are removed from the notches 350 and the upper member 310 and lower member 320 of the lock arm 300 telescope by sliding or passing the lower member 320 within the upper member 310. As this telescoping occurs, the lock arm 300 moves toward the support arm storage lock 400. Once the lock arm 300 is at the desired angle, the removable securing devices 360 are reinserted into the notches 350 to secure the lock arm 300, and therefore, firmly fix the support arm 200.

Figure 3:
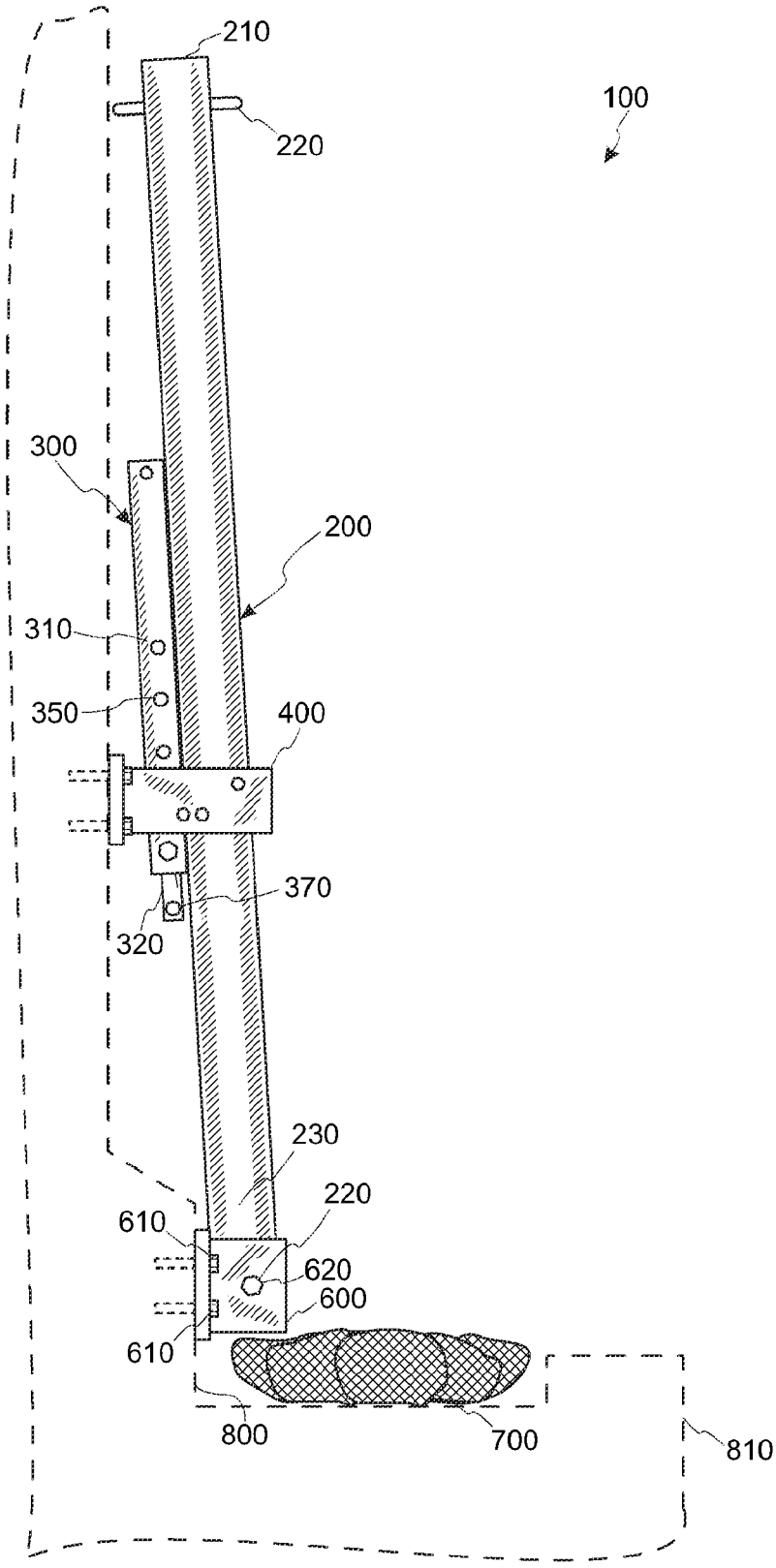
FIG. 3 shows a side view of the perimeter net system of FIG. 1 with the support arm in the closed position.

Further, as shown in FIG. 3, when the support arm 200 is in the closed position, the lock arm 300 is substantially parallel to the support arm 200. As the support arm 200 moves into the closed position, the lock arm 300 adjusts until the support arm 200 and the lock arm 300 are parallel. Once in the closed and stowed position, the support arm storage lock 400 secures the lock arm 300 and support arm 200 against the building support structure 800. When the support arm 200 is in the closed position, the net 700 is removed from the net cable 220 located at the outside end 210 of the support arm 200 and stowed below the pivot 600.

The preferred embodiment of the invention is described above, in the Drawings, and Description of Preferred Embodiments. While these descriptions directly describe the above embodiments, it is understood that those skilled in the art may conceive modifications and/or variations to the specific embodiments shown and described herein. Any such modifications or variations that fall within the purview of this description are intended to be included therein as well. Unless specifically noted, it is the intention of the inventor that the words and phrases in the specification and claims be given the ordinary and accustomed meanings to those of ordinary skill in the applicable art(s). The foregoing description of a preferred embodiment and best mode of the invention known to the applicant at the time of filing the application has been presented and is intended for the purposes of illustration and description. It is not intended to be exhaustive or to limit the invention to the precise form disclosed, and many modifications and variations are possible in the light of the above teachings. The embodiment was chosen and described in order to best explain the principles of the invention and its practical application and to enable others skilled in the art to best utilize the invention in various embodiments and with various modifications as are suited to the particular use contemplated.

What is claimed is:

1. A perimeter net system comprising:

A. a support arm, said support arm further comprising:

1. a first end;
2. a second end;

B. a pivot bracket;

C. a lock arm, said lock arm further comprising:

1. an upper end;
2. a lower end;
3. an upper member; and
4. a lower member;

D. a support arm storage lock;

E. a support cable, said support cable further comprising:

1. a top;
2. a bottom;

F. a net, said net further comprising:

1. a first side;
2. a second side;

G. said first end of said support arm is coupled to said pivot bracket, such that said support arm rotates around an axis of said pivot bracket;

H. said second end of said support arm is coupled to said bottom of said support cable;

I. said top of said support cable is coupled to said support arm storage lock;

J. said upper end of said lock arm is detachably coupled to said support arm storage lock;

K. said lower end of said lock arm is coupled along the length of said support arm such that said lower member of said lock arm telescopes into said upper member of said lock arm as said support arm rotates;

L. said first side of said net is coupled to said second end of said support arm with a first net cable; and M. said second side of said net is coupled along said length of said support arm with a second net cable.

2. The perimeter net system of claim 1 wherein:

A. said support arm is coupled to said pivot mount with an at least one pivot pin.

3. The perimeter net system of claim 1 wherein:

A. said support arm rotates between an open position and a closed position.

4. The perimeter net system of claim 3 wherein:

A. said support arm storage lock secures said support arm when said support arm is in said closed position.

5. The perimeter net system of claim 3 wherein:

A. said lock arm secures said support arm when said support arm is in said open position.

6. The perimeter net system of claim 3 wherein:

A. said support cable secures said support arm in said open position.

7. The perimeter net system of claim 1 wherein said lock arm upper member and lower member are detachably connected.

8. The perimeter net system of claim 7 wherein:

A. said upper member of said lock arm further comprises a plurality of notches; and B. said lower member of said lock arm is coupled to said support arm.

9. The perimeter net system of claim 3 wherein:

A. said first side of said net is detached from said first net cable when said support arm is in said closed position.

10. The perimeter net system of claim 1 wherein:

A. said pivot bracket is coupled to a building support structure.

11. The perimeter net system of claim 1 wherein:

A. said support arm storage lock is coupled to said building support structure some distance above said pivot bracket.

12. A method for using a perimeter net system comprising the steps of:

A. coupling a first end of a support arm to a pivot bracket, such that said support arm rotates around an axis of said pivot bracket;

B. coupling a second end of said support arm to a bottom of a support cable;

C. coupling a top of said support cable to a support arm storage lock;

D. coupling an upper end of a lock arm to said support arm storage lock, such that said lock arm is detachable;

E. coupling a lower end of said lock arm along the length of said support arm such that a lower member of said lock arm telescopes into an upper member of said lock arm as said support arm rotates;

F. coupling a first side of a net to a first net cable coupled to said second end of said support arm; and G. coupling a second side of said net to a second net cable couple to said length of said support arm.

13. The method of claim 12 further comprising the step of:

A. coupling said support arm to said pivot mount with an at least one pivot pin.

14. The method of claim 12 further comprising the step of:

A. rotating said support arm between an open position and a closed position.

15. The method of claim 14 further comprising the step of:

A. securing said support arm with said support arm storage lock when said support arm is in said closed position.

16. The method of claim 14 further comprising the step of:

A. securing said support arm with said support cable when said support arm is in said open position.

17. The method of claim 14 further comprising the step of:

A. securing said support arm with said lock arm when said support arm is in said open position.

18. The method of claim 12 further comprising the step of:

A. coupling said upper member and said lower member of said lock arm, wherein said first member further comprises notches, and such that said first member and said lower member are detachable.

19. The method of claim 14 further comprising the step of:

A. detaching said first side of said net from said first net cable when said support arm is in said closed position.

20. The method of claim 12 further comprising the step of:

A. coupling said pivot bracket to a building support structure.

* * * * *